US007001149B1

(12) United States Patent
Waggoner et al.

(10) Patent No.: US 7,001,149 B1
(45) Date of Patent: Feb. 21, 2006

(54) BLOWER HOUSING ASSEMBLY WITH MOUNTING TABS

(75) Inventors: Dennis Earl Waggoner, Avon Lake, OH (US); Joseph H. Andulics, N. Ridgeville, OH (US)

(73) Assignee: Beckett Air Incorporated, North Ridgeville, OH (US)

( * ) Notice: Subject to any disclaimer, the term of this patent is extended or adjusted under 35 U.S.C. 154(b) by 71 days.

(21) Appl. No.: 10/793,237

(22) Filed: Mar. 4, 2004

(51) Int. Cl.
*F04D 29/42* (2006.01)

(52) U.S. Cl. ..... 415/204; 415/213.1; 415/215.4

(58) Field of Classification Search ..... 415/204, 415/206, 213.1, 215.1
See application file for complete search history.

(56) References Cited

U.S. PATENT DOCUMENTS

| | | | | |
|---|---|---|---|---|
| 353,994 | A | 12/1886 | Walker et al. | |
| 3,250,457 | A * | 5/1966 | Walker | 415/211.1 |
| 3,332,611 | A | 7/1967 | Bednarski et al. | |
| 3,485,443 | A * | 12/1969 | Earhart | 415/200 |
| 3,627,442 | A * | 12/1971 | Brandt | 415/206 |
| 4,787,818 | A | 11/1988 | Bales et al. | |
| 5,040,943 | A | 8/1991 | Dwyer et al. | |
| 5,074,751 | A | 12/1991 | Sixsmith | |
| 5,158,432 | A * | 10/1992 | Cox | 415/214.1 |
| 5,555,647 | A | 9/1996 | Torborg et al. | |
| 5,690,470 | A | 11/1997 | Zimmer | |
| 5,749,702 | A | 5/1998 | Datta et al. | |
| 5,820,458 | A | 10/1998 | Lai | |
| 5,887,281 | A | 3/1999 | Green et al. | |
| 5,911,563 | A | 6/1999 | Duppert et al. | |
| 5,951,245 | A | 9/1999 | Sullivan | |
| 5,997,246 | A | 12/1999 | Humbad | |
| D443,054 | S | 5/2001 | Spaggiari | |
| 6,454,834 | B1 | 9/2002 | Livingstone et al. | |
| 6,468,034 | B1 | 10/2002 | Garrison et al. | |
| 6,511,288 | B1 | 1/2003 | Gatley, Jr. | |
| 6,655,926 | B1 | 12/2003 | Wang et al. | |
| 2003/0042003 | A1 | 3/2003 | Novotny et al. | |
| 2003/0175171 | A1 | 9/2003 | Yamamoto et al. | |

OTHER PUBLICATIONS

"Dayton Hi Temperature Blower Dimensions", Electric Motor Warehouse, Division of Winans Electric Motor Repair, date unknown, 1 pg., printed from the Internet at:: http://www.electricmotorwarehouse.com/hi_temp_dimensions.htm.

"Fans & Blowers-Squirrel Cage Types", date unknown, 10 pgs., printed from the internet at: http://www.surplussales.com/Fans-Blowers/FansBlow-1.html.

* cited by examiner

*Primary Examiner*—Ninh H. Nguyen
(74) *Attorney, Agent, or Firm*—Eschweiler & Associates, LLC

(57) ABSTRACT

The present invention is directed to a centrifugal blower, blower wheel housing, and a method for assembling a blower wheel housing. The blower wheel housing comprises a sheet metal scroll and a contiguous sheet metal first side plate having a substantially planar first sidewall portion and a first peripheral portion. The first peripheral portion comprises a first flange extending generally perpendicular to the first sidewall portion about a periphery thereof and one or more mounting tabs extending radially outward beyond the first flange, wherein the one or more mounting tabs are generally coplanar with the first sidewall portion. The first flange further fixedly engages a first portion of the scroll. Furthermore, the centrifugal blower comprises the blower wheel housing and a blower wheel operable to rotate therein.

19 Claims, 8 Drawing Sheets

BLOWER HOUSING ASSEMBLY WITH MOUNTING TABS

TECHNICAL FIELD OF INVENTION

The present invention relates to a blower assembly and methods of manufacturing the same. In particular, the invention relates to a blower wheel housing comprising one or more integral mounting tabs.

BACKGROUND OF THE INVENTION

Centrifugal blowers or fans are commonly used for air handling in various industries, such as in automotive applications, residential and commercial ventilation systems, and numerous other applications which require forced air flow. In a typical centrifugal blower, for example, air is drawn into a blower wheel housing through an inlet aperture by rotating a blower wheel within the housing. The air is then forced around the housing and out an exhaust aperture.

Typical blower wheel housings are of sheet metal construction and are generally formed of two side plates and a curvilinear scroll positioned therebetween, wherein the side plates and scroll are spot-welded together. Typically, the blower wheel housing is mounted to a support structure or other apparatus, wherein the blower is generally incorporated into a larger apparatus or system. In a conventional blower, the blower wheel housing is mounted to the support structure or other apparatus via a supplemental flange which is attached to a periphery of the exhaust aperture, or by supplemental mounting brackets which are attached to a side of the blower wheel housing. The supplemental flange or mounting brackets are typically physically separate members which are attached to the blower wheel housing by spot welding or crimping the flange or brackets to the housing. Thus, the attachment of the flange or mounting brackets typically requires an additional process step in the manufacture of the centrifugal blower.

Furthermore, additional costs can be incurred in providing the supplemental flange or mounting brackets, wherein the flange or mounting brackets are typically formed in operations which are separate from the formation of the side plates. Thus, the process for attaching the supplemental flange or mounting brackets to the side plate can incur additional fixturing costs wherein additional fixturing equipment and/or labor and time is involved in placing the supplemental flange or mounting brackets in a fixture prior to spot welding. Still further, the physically separate supplemental flanges or mounting brackets may require additional storage space in the manufacturing facility prior to their attachment to the blower wheel housing.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its primary purpose is to present some concepts of the invention in a simplified form as a prelude to the more detailed description that is presented later.

The present invention relates generally to a centrifugal blower, a blower wheel housing, and a method of manufacturing the same. The centrifugal blower comprises a blower wheel housing and a blower wheel, wherein the blower wheel is operable to rotate within the blower wheel housing, thus providing a flow of air through the blower. In accordance with one exemplary aspect of the present invention, the blower wheel housing comprises a first side plate and a scroll, wherein the first side plate comprises one or more mounting tabs which are integral thereto. Accordingly, the first side plate and the one or more mounting tabs are comprised of a contiguous sheet of metal, wherein the first side plate comprises a substantially planar first sidewall portion and a first peripheral portion.

The first peripheral portion comprises the one or more mounting tabs and a first flange, wherein the first flange extends generally perpendicular to the first sidewall portion about a periphery thereof. The first flange further fixedly engages a first portion of the scroll, such as by one or more spot welds. According to another exemplary aspect of the invention, the one or more mounting tabs are generally co-planar with the first sidewall portion and extend radially outward beyond the first flange. Providing the one or more mounting tabs which are generally contiguous with the first sidewall portion generally eliminates a need for additional processes involving an attachment of physically separate mounting brackets, thus advantageously lowering a cost of manufacturing the blower wheel housing.

In accordance with yet another exemplary aspect of the invention, a method of forming a blower wheel housing is provided, wherein the method comprises forming a sheet metal blank from a generally planar sheet of metal. A predetermined pattern is formed, such as by laser cutting or stamping the sheet of metal, wherein the predetermined pattern generally defines the sheet metal blank. The sheet metal blank comprises a sidewall portion and a peripheral portion, wherein one or more mounting tab portions and a flange portion are further defined in the peripheral portion. The flange portion is further bent generally perpendicularly to the sidewall portion and the one or more mounting tab portions, therein defining a first side plate comprising a first flange and one or more mounting tabs, wherein the one or more mounting tabs are generally contiguous to and co-planar with the sidewall portion. The first flange can be further fixedly attached to a curvilinear scroll, and a second side plate, for example, can be further fixedly attached to the curvilinear scroll.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
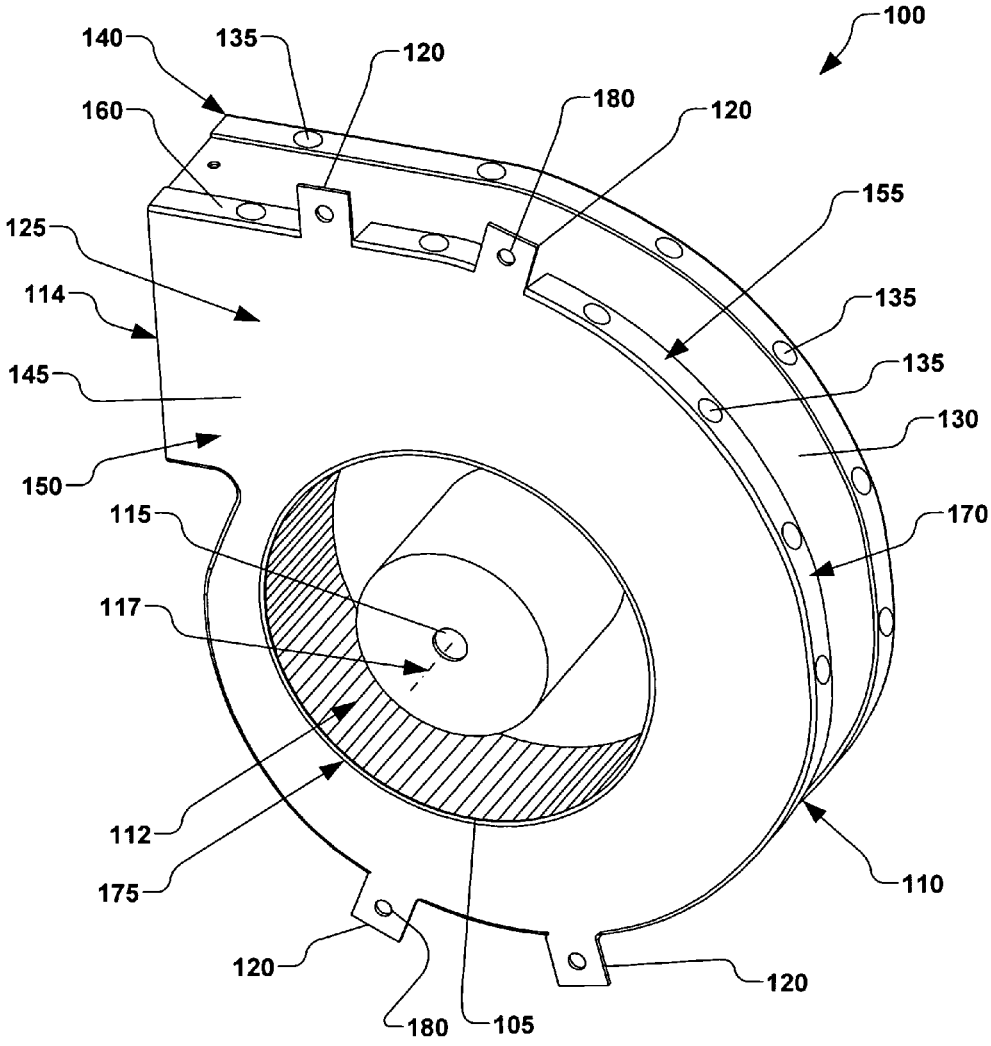
FIG. 1 illustrates a perspective view of an exemplary blower device according to one aspect of the present invention.

The present invention will now be described with reference to the drawings wherein like reference numerals are used to refer to like elements throughout. It should be understood that the description of these aspects are merely illustrative and that they should not be taken in a limiting sense. In the following description, for purposes of explanation, numerous specific details are set forth in order to provide a thorough understanding of the present invention. It will be evident to one skilled in the art, however, that the present invention may be practiced without these specific details. In other instances, well-known structures and devices are shown in block diagram form in order to facilitate description of the present invention.

Referring now to the figures, several aspects of the present invention are presented. FIG. 1 illustrates a perspective view of an exemplary centrifugal blower 100, wherein the blower generally comprises a blower wheel 105 and a blower wheel housing 110. The blower 100, for example, is operable to provide a flow of air by drawing a volume of air through an inlet 112 and emitting a volume of air through an exhaust 114 by rotating the blower wheel 105 within the blower wheel housing 110, as will be understood by one of ordinary skill in the art. The blower wheel 105 is further coupled to an axle 115, wherein the axle generally defines a generally fixed axis 117 about which the blower wheel is operable to rotate. The axle 115, for example, is further associated with a motor (not shown), wherein the motor is generally fixed with respect to the blower wheel housing 110. The motor, therefore, is operable to rotate the axle 115 and blower wheel 105 about the axis 117, wherein the rotation the blower wheel with respect to the blower wheel housing 110 induces the flow of air through the inlet 112 and out of the exhaust 114.

Figure 2A:
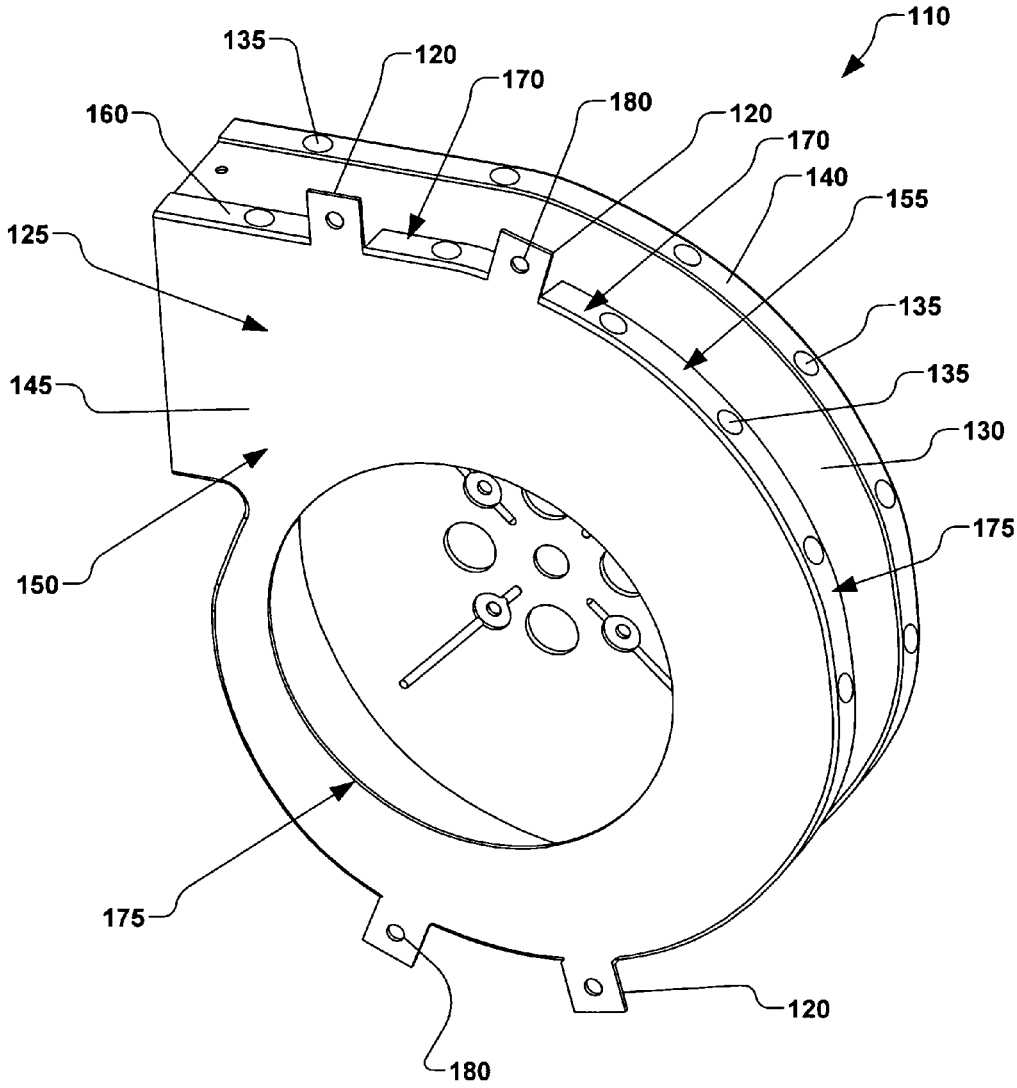
FIG. 2A illustrates a perspective view of an exemplary blower wheel housing according to another aspect of the present invention.
Figure 2B:
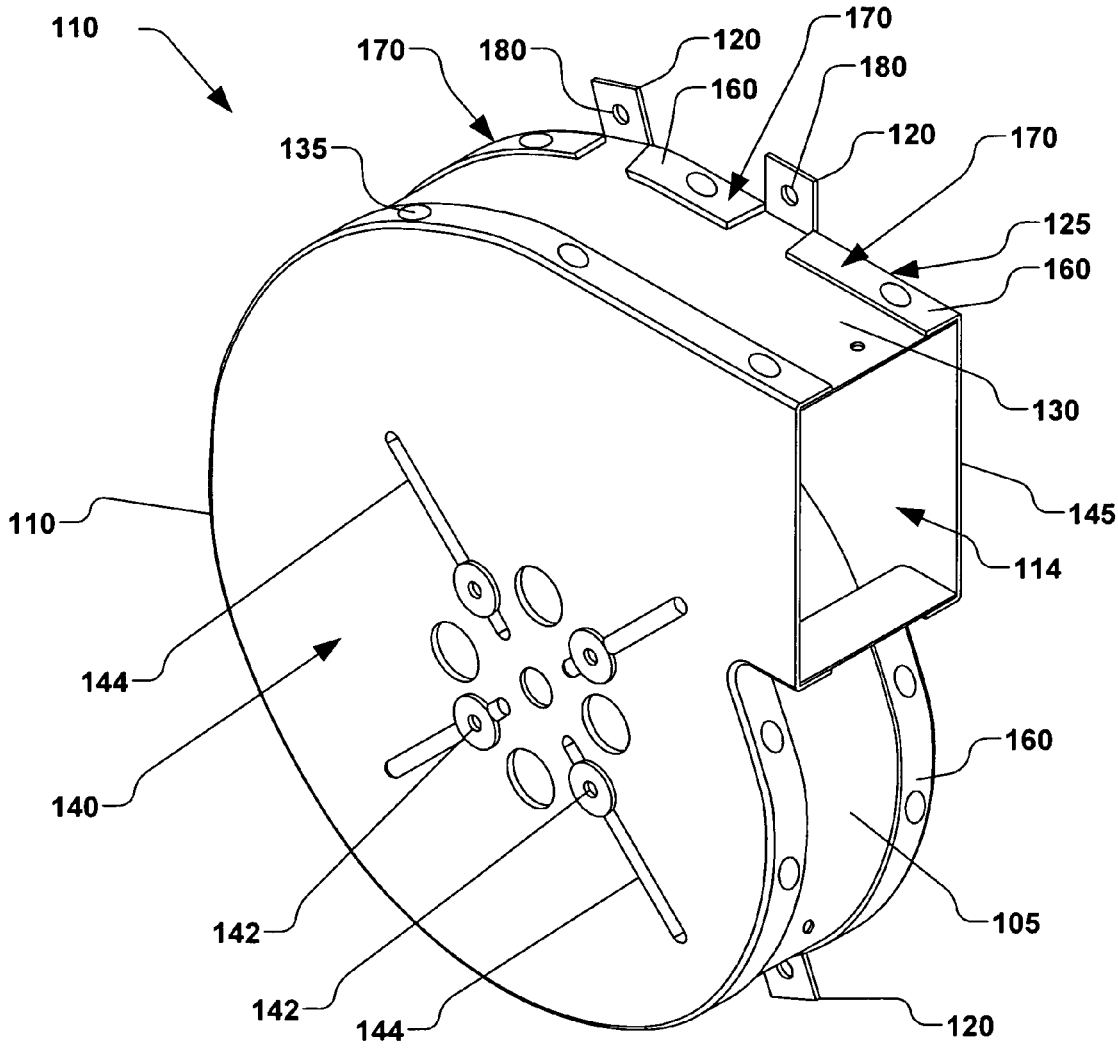
FIG. 2B illustrates another perspective view of the exemplary blower wheel housing of FIG. 2A.

In accordance with one exemplary aspect of the present invention, the blower wheel housing 110 comprises one or more mounting tabs 120, wherein the one or more mounting tabs generally permit the blower 100 to be mounted to one or more surfaces (not shown), such as a sidewall of a furnace or other device. FIG. 2A illustrates an exemplary perspective view of the blower wheel housing 110, wherein the blower wheel housing further comprises a first side plate 125 and a curvilinear scroll 130. The first side plate 125, for example, is fixedly coupled to the scroll 130, such as by one or more spot welds 135. Alternatively, the first side plate 125 is coupled to the scroll 130 by a crimp (not shown) between the first side plate and the scroll. According to another example, the blower wheel housing 110 further comprises a second side plate 140, wherein the second side plate is further fixedly coupled to the scroll 130, such as by one or more spot welds 135. Again, the second side plate 140 can be alternatively fixedly attached to the scroll 130 by crimping (not shown). According to yet another example, the second side plate 140 is integral to the scroll 130, wherein the second side plate and the scroll are comprised of one contiguous sheet of metal or other material. FIG. 2B illustrates another perspective view of the blower wheel housing 110 of FIG. 2A, wherein the second side plate 140 further comprises one or more mounting holes 142 for mounting the motor (not shown) thereto. The second side plate 140, for example, further comprises one or more ribs 144, wherein the one or more ribs are operable to provide an amount of rigidity to the second side plate.

Figure 3A:
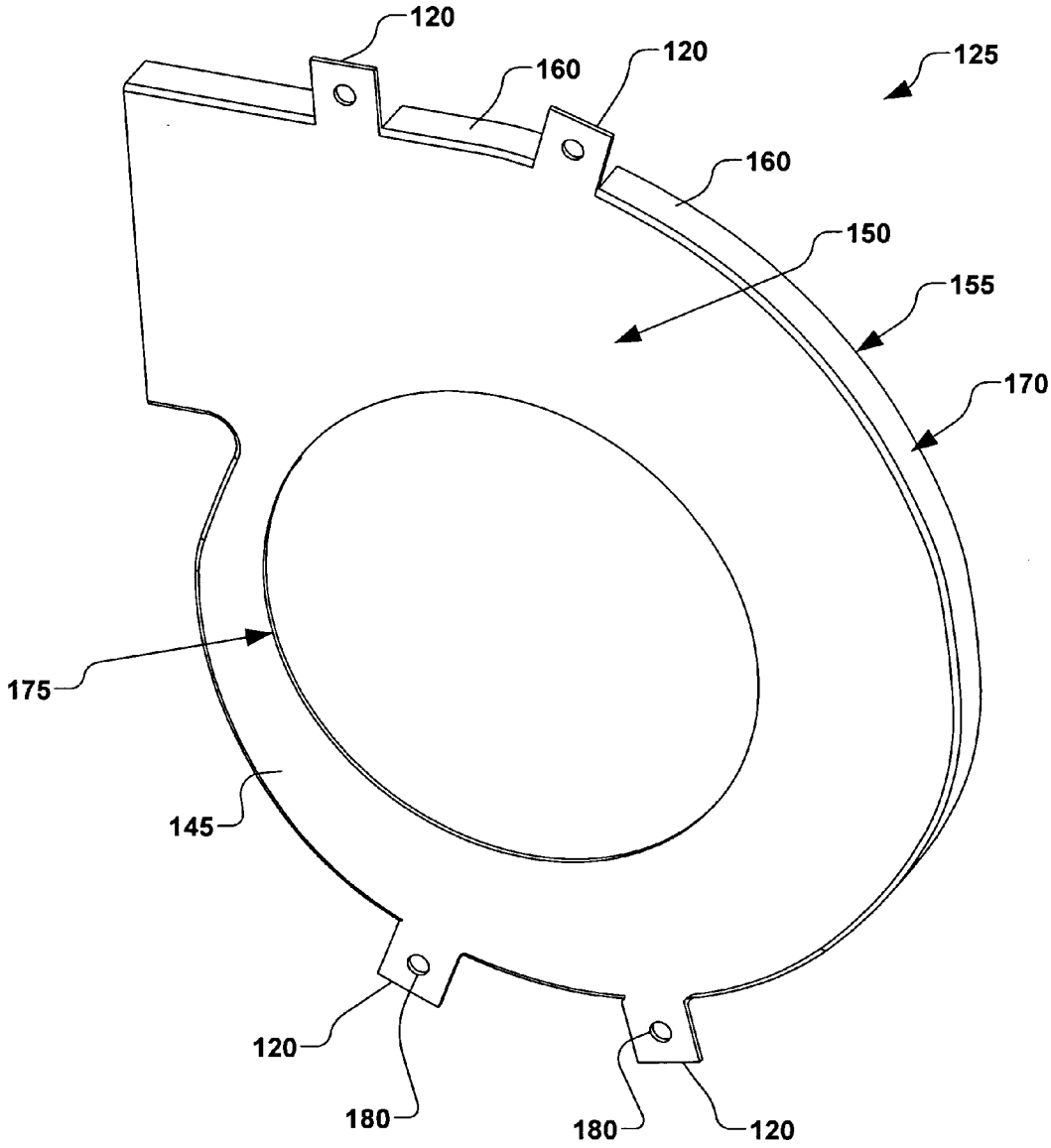
FIG. 3A illustrates a perspective view of an exemplary first side plate of a blower wheel housing in accordance with another exemplary aspect of the invention.
Figure 3B:
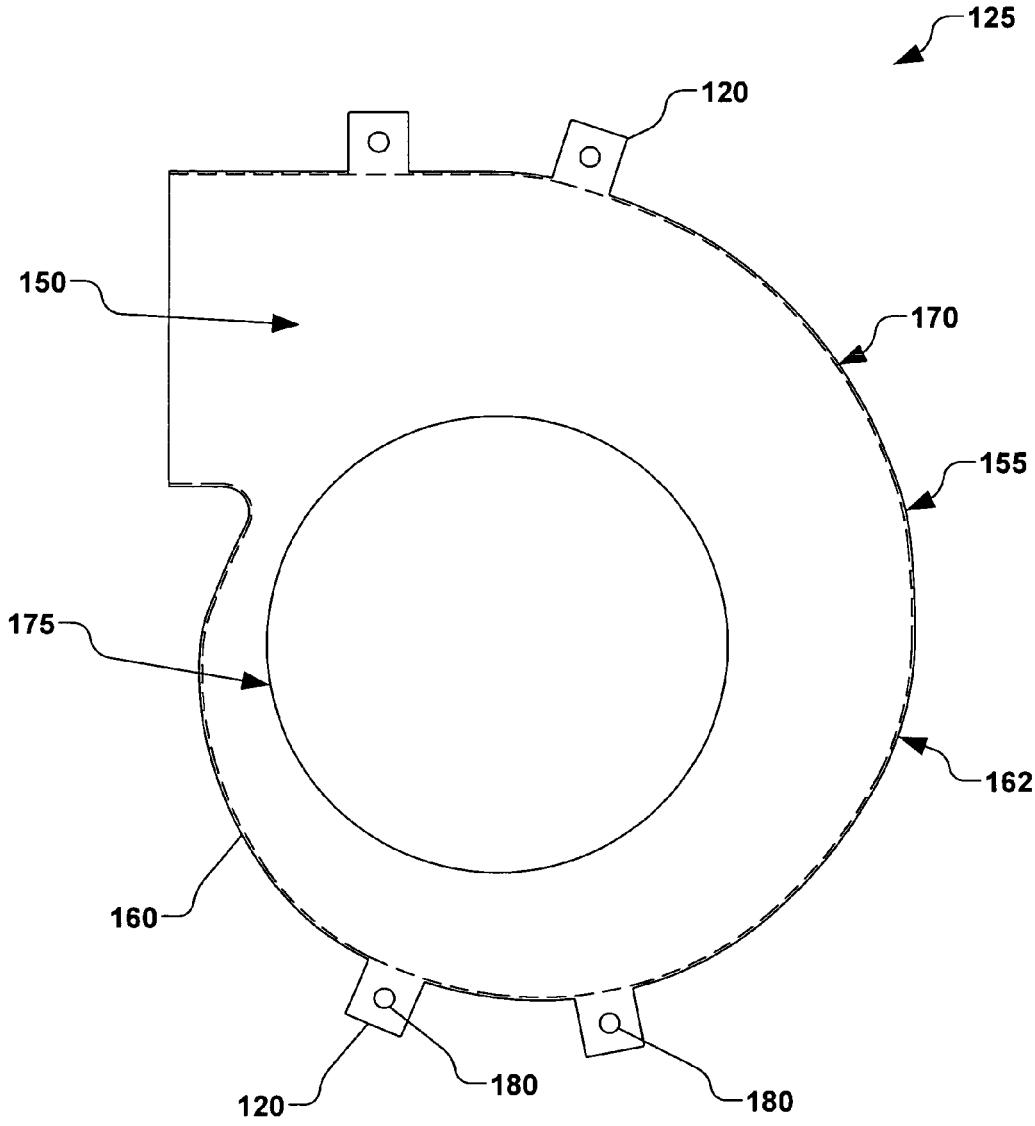
FIG. 3B illustrates a plan view of the first side plate of FIG. 3A.
Figure 3C:
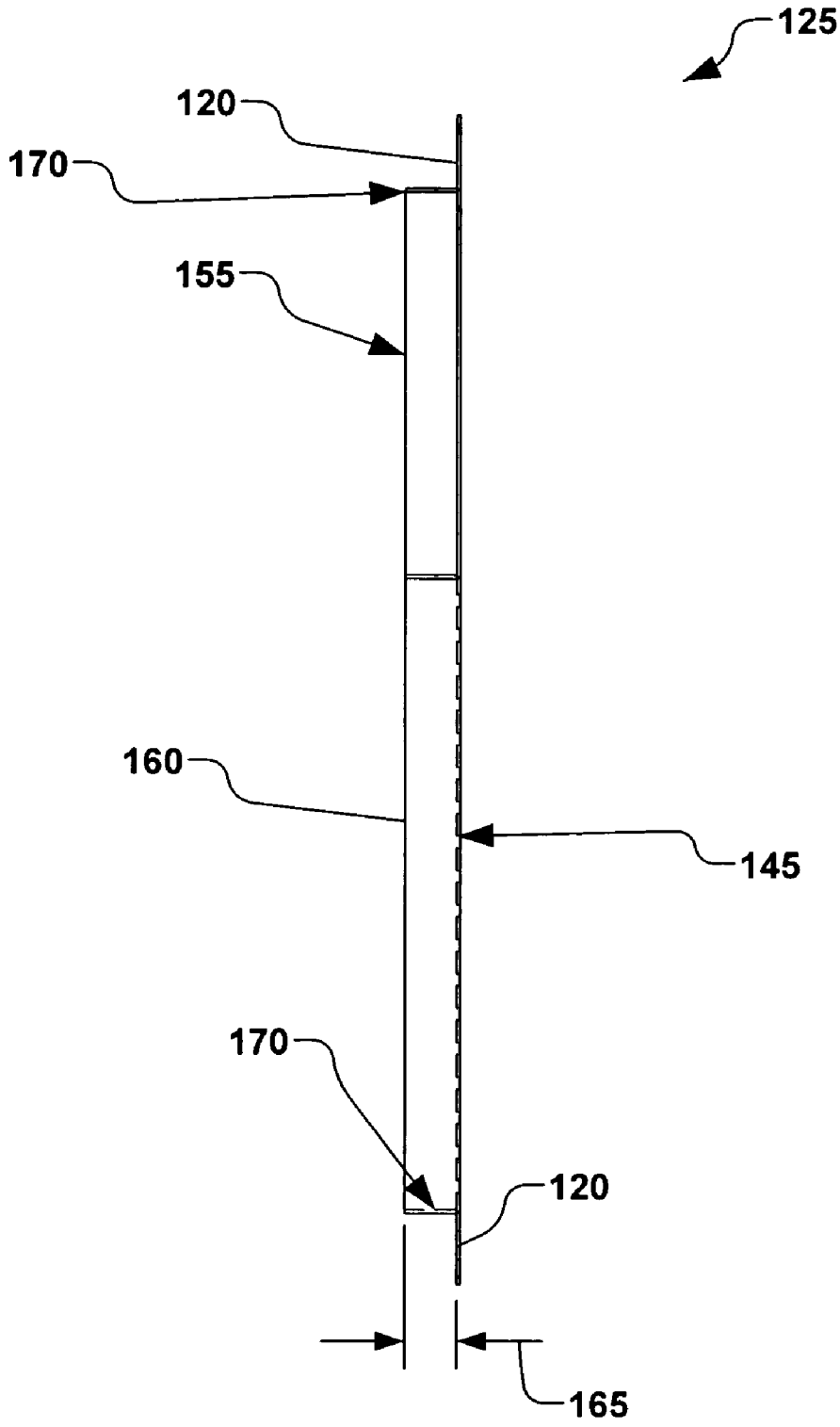
FIG. 3C illustrates a side view of the side plate of FIGS. 3A and 3B.

In accordance with another aspect of the present invention, the first side plate 125 is further illustrated in FIGS. 3A–3C. As seen in the perspective view of FIG. 3A, for example, the first side plate 125 is comprised of a unitary, contiguous sheet of metal (hereafter referred to as sheet metal 145), wherein the first side plate comprises a substantially planar first sidewall portion 150 and a first peripheral portion 155. The first sidewall portion 150 and first peripheral portion 155, for example, are formed by a bending or pressing operation, as will be discussed infra. The sheet metal 145 for example, is preferably comprised of steel, however, aluminum or various other metals or formable materials which are operable to provide a significant rigidity to the blower wheel housing 100 of FIG. 1 are also considered by the inventor to fall within the scope of the present invention.

The first peripheral portion 155 of the first side plate 125 illustrated in FIG. 3A, for example, comprises a first flange 160, wherein the first flange extends generally perpendicularly from the first sidewall portion 150. FIGS. 3B and 3C illustrate respective plan and side views of the first side plate 125, wherein the exemplary first flange 160, for example, extends a first distance 165 from the first sidewall portion 150 about a periphery 162 thereof. The first distance 165 is further associated with an interface region 170 between the scroll 130 and the first side plate 125, as illustrated again in FIGS. 2A and 2B. The interface region 170, for example, is generally defined by an overlap of the first flange 160 and the scroll 130. The first flange 160 and the scroll 130, for example, are further bonded to one another within the interface region 170, such as by the one or more spot welds 135 as discussed above, thus fixedly coupling the scroll to the first side plate 125. The first sidewall portion 150 of the first side plate 125, as illustrated in FIGS. 3A and 3B, further comprises an opening 175, wherein the opening is further associated with the blower wheel 105 of FIG. 1.

According to another exemplary aspect of the invention, the first side plate 125 comprises the one or more mounting tabs 120, wherein the one or more mounting tabs are generally contiguous and co-planar with the first sidewall portion 150. The one or more mounting tabs 120, for example, generally extend radially outward from the first flange 130, as can be seen in FIG. 3B, wherein the one or more mounting tabs are contiguous with the first sidewall portion 150. Various manufacturing advantages can be realized during a formation of the first side plate 125 by providing the contiguous one or more mounting tabs 120, such as an elimination of assembly fixtures for welding non-contiguous (i.e., physically separate) mounting tabs (not shown) to the first side plate 125, as will be further discussed infra. The one or more mounting tabs 120, for example, further comprise a mounting hole 180 therethrough, wherein the mounting hole generally permits a fastening of the first side plate 125, and hence a fastening of the blower 100 of FIG. 1, to any number of surfaces or devices (not shown)

which may incorporate the blower wheel housing, such as a furnace or other device incorporating the blower.

Figure 4:
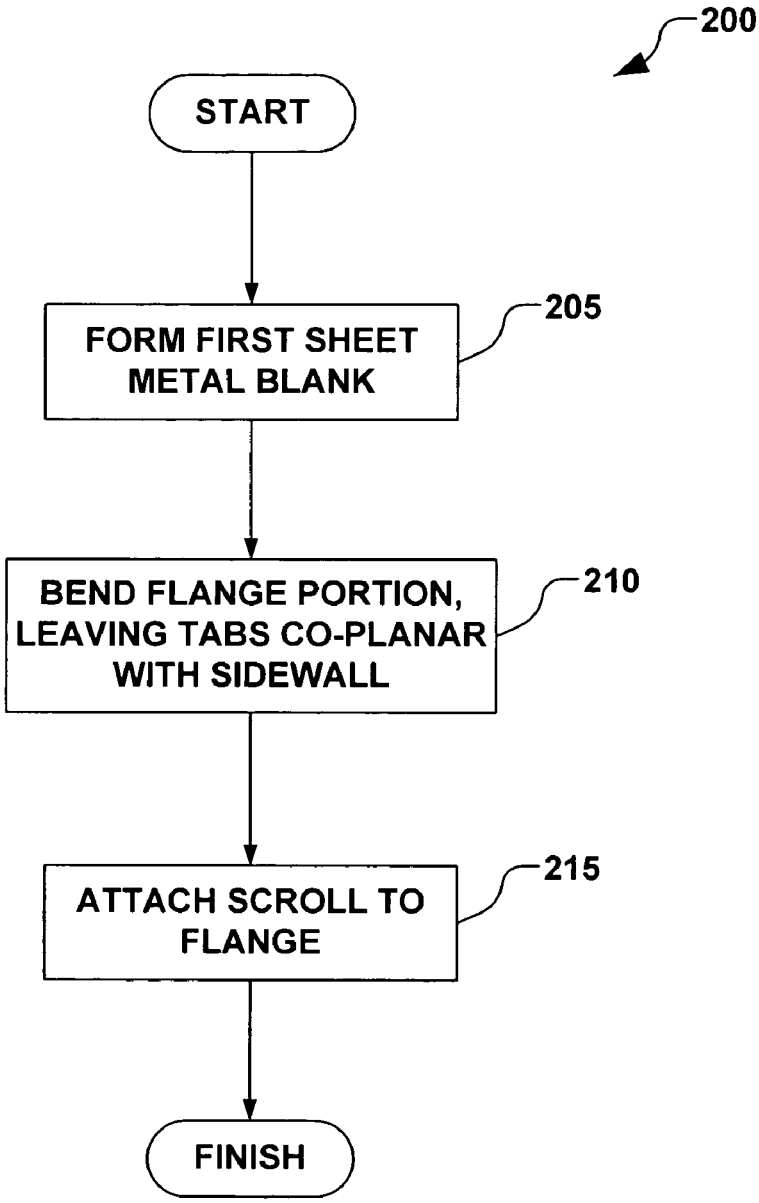
FIG. 4 illustrates a method for forming a blower wheel housing in accordance with another exemplary aspect of the present invention.

FIG. 4 illustrates a method 200 for forming a blower wheel housing in accordance with another aspect of the present invention. While exemplary methods are illustrated and described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the methods may be implemented in association with the apparatus and systems illustrated and described herein as well as in association with other systems not illustrated.

Figure 5:
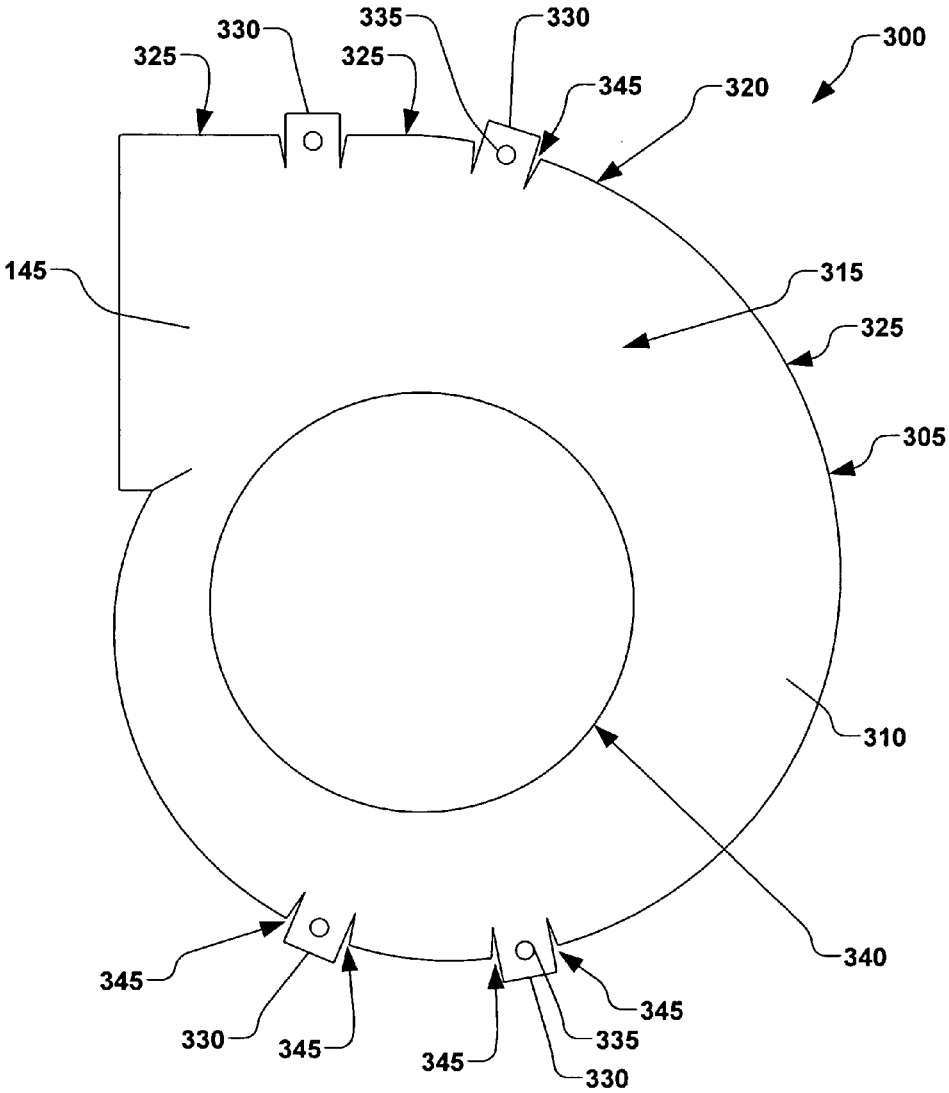
FIG. 5 illustrates a plan view of a first blank according to yet another exemplary aspect of the present invention.

The method 200 begins with act 205, wherein a first sheet metal blank is formed from a contiguous sheet of metal. FIG. 5 illustrates an exemplary sheet metal blank 300 which is formed in act 205 of FIG. 4. According to one exemplary aspect of the invention, forming the sheet metal blank 300 of FIG. 5 in act 205 comprises forming a predetermined pattern 305 in a generally planar and contiguous sheet of metal 310, wherein the predetermined pattern 305 comprises a sidewall portion 315 and a peripheral portion 320. For example, forming the predetermined pattern 305 in act 205 of FIG. 4 comprises a stamping operation or laser cutting operation, wherein the predetermined pattern 305 is formed from a roll of sheet metal (not shown), as will be understood by one of ordinary skill in the art. The formation of the predetermined pattern 305 in act 205 of FIG. 4, for example, further generally defines a flange portion 325 and one or more mounting tab portions 330 associated with the peripheral portion 320. According to another example, forming the sheet metal blank 300 further comprises forming one or more mounting holes 335 associated with the one or more respective mounting tab portions 330. Furthermore, according to another example, the formation of the sheet metal blank in act 205 further comprises forming an opening 340, wherein the opening is associated with a blower wheel (not shown).

In act 210 of FIG. 4, the flange portion 325 of FIG. 5 is bent generally perpendicularly to both the sidewall portion 315 and one or more mounting tab portions 330. The bending of the flange portion 325 in act 210 consequently defines the first side plate 125 comprising the first flange 160 and the one or more respective mounting tabs 120, as illustrated in FIGS. 3A–3C, wherein the one or more mounting tabs remain generally coplanar with the sidewall portion 315 of FIG. 5. The bending of the flange portion in act 210, for example, comprises a press operation, wherein one or more notches 345 of FIG. 5 generally permit the flange portion 325 to bend with respect to the one or more mounting tab portions 330. The one or more notches 345, for example, are angled with respect to the one or more mounting tab portions 330, therein generally providing a clearance for bending the flange portion 325 with respect to the one or more mounting tabs portions. Such notches 345 further generally permit the flange portion 325 to be curvilinear, such that the resultant first side plate 125 of FIG. 2A, for example, is operable to mate with the curvilinear scroll 130.

According to still another exemplary aspect of the invention, the method 200 of FIG. 4 further comprises fixedly attaching the first flange to a first portion of the curvilinear scroll in act 215. The first portion of the curvilinear scroll, for example, is defined by the interface region 170 illustrated in FIG. 2A. In act 215, for example, the first flange 160 is fixedly attached to the scroll 130 by spot welding the first flange to the first portion of the scroll in a plurality of locations associated with the first flange, as illustrated by the spot welds 135 in FIG. 2A. In accordance with yet another exemplary aspect of the present invention, a second side plate can be formed, wherein the second side plate is further fixedly attached to the scroll, wherein the result is again illustrated in FIG. 2B. Again, the second side plate 140 and the scroll 130 may be fixedly attached to one another by spot welding or crimping the second side plate to the scroll.

Although the invention has been shown and described with respect to certain aspects, equivalent alterations and modifications will occur to others skilled in the art upon the reading and understanding of this specification and the annexed drawings. In particular regard to the various functions performed by the above described components (systems, devices, assemblies, etc.), the terms used to describe such components are intended to correspond, unless otherwise indicated, to any component which performs the specified function of the described component (i.e., that is functionally equivalent), even though not structurally equivalent to the disclosed structure that performs the function in the herein illustrated exemplary aspects of the invention. In addition, while a particular feature of the invention may have been disclosed with respect to only one of several aspects, such feature may be combined with one or more other features of the other aspects as may be desired and advantageous for any given or particular application. Furthermore, to the extent that the term "includes" is used in either the detailed description and the claims, such term is intended to be inclusive in a manner similar to the term "comprising."

What is claimed is:

1. A blower wheel housing, comprising:

a sheet metal scroll; and a contiguous sheet metal first side plate having a substantially planar first sidewall portion and a first peripheral portion, wherein the first peripheral portion comprises a first flange extending generally perpendicular to the first sidewall portion about a periphery thereof and having one or more notches defined therein, wherein the first flange fixedly engages a first portion of the scroll, and wherein the first peripheral portion further comprises one or more mounting tabs associated with the one or more notches extending radially outward beyond the first flange, wherein the one or more mounting tabs are generally coplanar with the first sidewall portion.

2. The blower wheel housing of claim 1, wherein the first side plate and the scroll are fixedly attached to one another by spot welds.

3. The blower wheel housing of claim 1, wherein the one or more mounting tabs each comprise a mounting hole therethrough.

4. The blower wheel housing of claim 1, further comprising a second side plate, wherein the second side plate comprises a second flange, and wherein the second flange fixedly engages a second portion of the scroll, wherein the scroll is generally sandwiched between the first side plate and the second side plate.

5. The blower wheel housing of claim 4, wherein the second side plate and scroll are fixedly attached to one another by spot welds.

6. The blower wheel housing of claim 4, wherein the second side plate further comprises one or more motor mounting holes therethrough.

7. The blower wheel housing of claim 1, wherein the scroll is curvilinear.

8. The blower wheel housing of claim 1, wherein the scroll further comprises a second side plate, wherein scroll and the second side plate are comprised of a contiguous sheet of metal.

9. A method of forming a blower wheel housing, the method comprising:

forming a predetermined pattern in a generally planar contiguous sheet of metal, therein forming a generally planar first sheet metal blank, wherein the predetermined pattern comprises a sidewall portion and a peripheral portion, wherein the peripheral portion further comprises a flange portion and one or more mounting tab portions; and bending the flange portion generally perpendicularly to the sidewall portion and one or more mounting tab portions, therein defining a first side plate comprising a first flange and one or more respective mounting tabs, wherein the one or more mounting tabs remain generally coplanar with the sidewall portion.

10. The method of claim 9, wherein forming the predetermined pattern comprises stamping the sheet of metal.

11. The method of claim 9, wherein forming the predetermined pattern comprises laser cutting the sheet of metal.

12. The method of claim 9, further comprising fixedly attaching the first flange to a first portion of a curvilinear scroll.

13. The method of claim 12, wherein fixedly attaching the first flange to the first portion of the scroll comprises spot welding the first flange to the first portion of the scroll in a plurality of locations associated with the first flange.

14. The method of claim 12, further comprising:

forming a second side plate; and fixedly attaching the second side plate to the scroll.

15. The method of claim 14, wherein the second side plate is fixedly attached to the scroll by spot welding.

16. A centrifugal blower, comprising:

a blower wheel housing, the blower wheel housing comprising:

a sheet metal scroll; and a contiguous sheet metal first side plate having a substantially planar first sidewall portion and a first peripheral portion, wherein the first peripheral portion comprises a first flange extending generally perpendicular to the first sidewall portion about a periphery thereof and having one or more notches defined therein, wherein the first flange fixedly engages a first portion of the scroll, and wherein the first peripheral portion further comprises one or more mounting tabs associated with the one or more notches extending radially outward beyond the first flange, wherein the one or more mounting tabs are generally coplanar with the first sidewall portion;

a blower wheel rotatably coupled to the blower wheel housing, wherein the blower wheel is operable to provide a flow of air by rotating the blower wheel within the blower wheel housing.

17. The centrifugal blower of claim 16, wherein the blower wheel housing further comprises a second side plate, wherein the second side plate comprises a second flange, and wherein the second flange fixedly engages a second portion of the scroll, wherein the scroll is generally sandwiched between the first side plate and the second side plate.

18. The centrifugal blower of claim 16, wherein the scroll further comprises a second side plate, wherein scroll and the second side plate are comprised of a contiguous sheet of metal.

19. The centrifugal blower of claim 16, further comprising a motor, wherein the motor rotatably couples the blower wheel to the blower wheel housing.

* * * * *